US007101273B2

(12) United States Patent
Tseng et al.

(10) Patent No.: US 7,101,273 B2
(45) Date of Patent: Sep. 5, 2006

(54) CARRIER HEAD WITH GIMBAL MECHANISM

(75) Inventors: Ming-Kuei Tseng, San Jose, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/237,062

(22) Filed: Sep. 28, 2005

(65) Prior Publication Data

US 2006/0025058 A1 Feb. 2, 2006

Related U.S. Application Data

(63) Continuation-in-part of application No. 11/054,128, filed on Feb. 8, 2005, now Pat. No. 7,001,257, which is a continuation of application No. 09/712,389, filed on Nov. 3, 2000, now Pat. No. 6,857,945.

(60) Provisional application No. 60/220,641, filed on Jul. 25, 2000.

(51) Int. Cl.
*B24B 5/00* (2006.01)

(52) U.S. Cl. ..... 451/288; 451/398

(58) Field of Classification Search ..... 451/285–289, 451/388, 397, 398, 41; 438/691–693
See application file for complete search history.

(56) References Cited

U.S. PATENT DOCUMENTS

| | | | | |
|---|---|---|---|---|
| 5,205,082 | A | 4/1993 | Shendon et al. | |
| 5,423,716 | A | 6/1995 | Strasbaugh | |
| 5,759,918 | A | 6/1998 | Hoshizaki et al. | |
| 5,762,544 | A | 6/1998 | Zuniga et al. | |
| 5,851,140 | A | 12/1998 | Barns et al. | |
| 6,183,354 | B1 * | 2/2001 | Zuniga et al. | 451/285 |
| 6,648,740 | B1 * | 11/2003 | Perlov et al. | 451/288 |
| 6,663,466 | B1 * | 12/2003 | Chen et al. | 451/8 |
| 2003/0068966 | A1 * | 4/2003 | Chen et al. | 451/398 |

* cited by examiner

*Primary Examiner*—Dung Van Nguyen
(74) *Attorney, Agent, or Firm*—Fish & Richardson

(57) ABSTRACT

A carrier head includes a housing connectable to a drive shaft to rotate therewith, a lower assembly having a substrate mounting surface, and a gimbal mechanism that connects the housing to the lower assembly to permit the lower assembly to pivot with respect to the housing about an axis substantially parallel to the polishing surface. The gimbal mechanism includes a shaft having an upper end slidably disposed in a vertical passage in a vertical passage in the housing, and a lower member that connects a lower end of the shaft to the lower assembly. The lower member bends to permit the base to pivot with respect to the housing. The shaft and the lower member are a unitary body.

12 Claims, 3 Drawing Sheets

CARRIER HEAD WITH GIMBAL MECHANISM

CROSS-REFERENCE TO RELATED APPLICATIONS

This application is a continuation-in-part of U.S. application Ser. No. 11/054,128, filed on Feb. 8, 2005 now U.S. Pat. No. 7,001,257, which is a continuation of U.S. application Ser. No. 09/712,389 now U.S. Pat. No. 6,857,945, filed on Nov. 3, 2000, which claims priority to U.S. application Ser. No. 60/220,641, filed on Jul. 25, 2000, each of which is incorporated by reference.

BACKGROUND

The present invention relates generally to chemical mechanical polishing of substrates, and more particularly to a carrier head for use in chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

SUMMARY

In one aspect, the invention is directed to a carrier head for positioning a substrate on a polishing surface. The carrier head includes a housing connectable to a drive shaft to rotate therewith, a lower assembly having a substrate mounting surface, and a gimbal mechanism that connects the housing to the lower assembly to permit the lower assembly to pivot with respect to the housing about an axis substantially parallel to the polishing surface. The gimbal mechanism includes a shaft having an upper end slidably disposed in a vertical passage in a vertical passage in the housing, and a lower member that connects a lower end of the shaft to the lower assembly. The lower member bends to permit the base to pivot with respect to the housing. The shaft and the lower member are a unitary body.

Implementations of the invention may include one or more of the following features. The lower member may be an annular ring with an inner circumferential portion joined to the shaft and an outer circumferential portion connected to the lower assembly. The lower member may be bendable vertically but be rigid radially. The lower assembly may include a flexible membrane having the mounting surface for the substrate. The flexible membrane may extend beneath the lower member to define a boundary of a pressurizable chamber. The lower assembly may include a rigid annular body joined to the lower member. A retaining ring may be secured to an outer lower surface of the rigid annular body. The flexible membrane may be secured to the rigid annular body. The flexible membrane may include a plurality of flaps, and the lower assembly may include at least one clamp ring securing the plurality of flaps to the rigid annular body. The lower assembly may include a retaining ring. A stop may be formed at the upper end of the shaft to engage a surface of the housing to prevent downward motion of the base. A loading mechanism may connect the housing to the base to apply a downward pressure to the base. The loading mechanism may include a flexure sealing a volume between the lower assembly and the housing to form a pressurizable chamber.

Implementations of the invention may include one or more of the following advantages. A monolithic gimbal can reduce head run-out, allow easier access to the wafer sensor, simplify the carrier head rebuild procedure, and reduce or eliminate a source of cross-talk between chambers.

DETAILED DESCRIPTION

Figure 1:
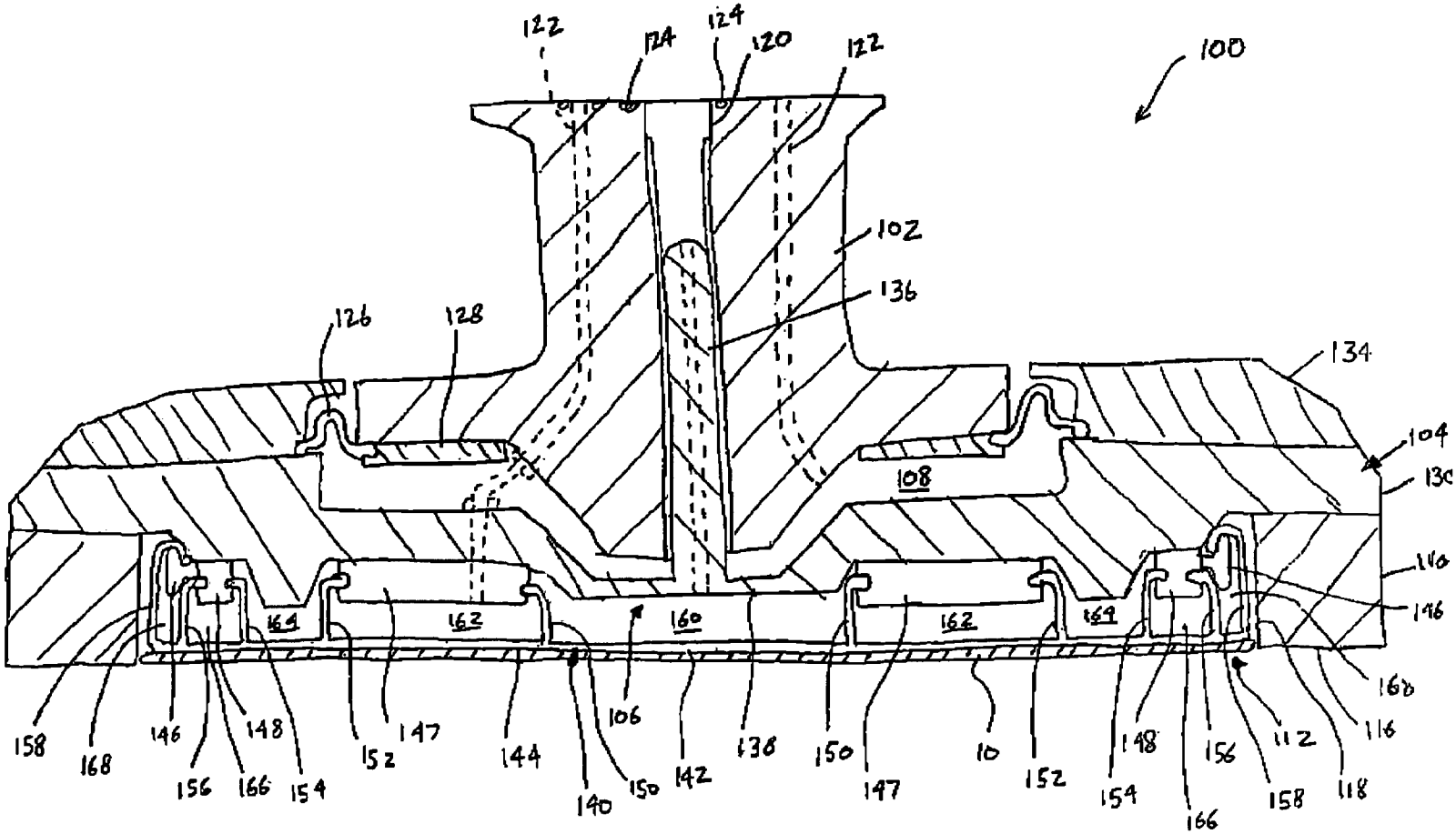
FIG. 1 is a cross-sectional view of a carrier head according to the present invention.

Referring to FIG. 1, the carrier head 100 includes a housing 102, a base assembly 104, a gimbal mechanism 106 (which may be considered part of the base assembly), a loading chamber 108, a retaining ring 110, and a substrate backing assembly 112 which includes five pressurizable chambers. A description of a similar carrier head may be found in U.S. Pat. No. 6,183,354, the entire disclosure of which is incorporated herein by reference.

The housing 102 can generally circular in shape and can be connected to the drive shaft 74 to rotate therewith during polishing. A vertical bore 120 may be formed through the housing 102, and five additional passages 122 (only two passages are illustrated) may extend through the housing 102 for pneumatic control of the carrier head. O-rings 124 may be used to form fluid-tight seals between the passages through the housing and passages through the drive shaft.

The base assembly 104 is a vertically movable assembly located beneath the housing 102. The base assembly 104 includes a generally rigid annular body 130, an outer clamp ring 134, and the gimbal mechanism 106. The gimbal mechanism 106 includes a gimbal rod 136 which slides vertically the along bore 120 to provide vertical motion of the base assembly 104, and a flexure ring 138 which bends to permit the base assembly to pivot with respect to the housing 102 so that the retaining ring 110 may remain substantially parallel with the surface of the polishing pad.

As illustrated in FIG. 1, the gimbal rod 136 and flexure ring 138 can be a monolithic body, rather than being separate pieces attached by screws, bolts or other components.

For example, the gimbal rod 136 and flexure ring 138 can be machined from one piece of raw material, such as a hard plastic or metal. A monolithic gimbal can reduce head run-out, allow easier access to the wafer sensor, simplify the carrier head rebuild procedure, and reduce or eliminate a source of cross-talk between chambers. In addition, a recess can be formed in the center of the bottom surface of the gimbal mechanism 106. A portion of a substrate sensor mechanism, such as the movable pin as described in U.S. Pat. No. 6,663,466, can fit into the recess.

Similarly, the rigid annular body 130 and the flexure ring 138 can be a monolithic body.

Alternatively, the flexure ring 138 can be joined to the annular body 130, e.g., by screws, as described in the above-mentioned U.S. Pat. No. 6,183,354.

The loading chamber 108 is located between the housing 102 and the base assembly 104 to apply a load, i.e., a downward pressure or weight, to the base assembly 104. The vertical position of the base assembly 104 relative to the polishing pad 32 is also controlled by the loading chamber 108. An inner edge of a generally ring-shaped rolling diaphragm 126 may be clamped to the housing 102 by an inner clamp ring 128. An outer edge of the rolling diaphragm 126 may be clamped to the base assembly 104 by the outer clamp ring 134.

The retaining ring 110 may be a generally annular ring secured at the outer edge of the base assembly 104. When fluid is pumped into the loading chamber 108 and the base assembly 104 is pushed downwardly, the retaining ring 110 is also pushed downwardly to apply a load to the polishing pad 32. A bottom surface 116 of the retaining ring 110 may be substantially flat, or it may have a plurality of channels to facilitate transport of slurry from outside the retaining ring to the substrate. An inner surface 118 of the retaining ring 110 engages the substrate to prevent it from escaping from beneath the carrier head.

The substrate backing assembly 112 includes a flexible membrane 140 with a generally flat main portion 142 and five concentric annular flaps 150, 152, 154, 156, and 158 extending from the main portion 142. The edge of the outermost flap 158 provides a perimeter portion of the membrane that is clamped between the base assembly 104 and a first clamp ring 146. Two other flaps 150, 152 are clamped to the base assembly 104 by a second clamp ring 147, and the remaining two flaps 154 and 156 are clamped to the base assembly 104 by a third clamp ring 148. A lower surface 144 of the main portion 142 provides a mounting surface for the substrate 10.

The volume between the base assembly 104 and the internal membrane 140 that is sealed by the first flap 150 provides a first circular pressurizable chamber 160. The volume between the base assembly 104 and the internal membrane 150 that is sealed between the first flap 150 and the second flap 152 provides a second pressurizable annular chamber 162 surrounding the first chamber 160. Similarly, the volume between the second flap 152 and the third flap 154 provides a third pressurizable chamber 164, the volume between the third flap 154 and the fourth flap 156 provides a fourth pressurizable chamber 166, and the volume between the fourth flap 156 and the fifth flap 158 provides a fifth pressurizable chamber 168. As illustrated, the outermost chamber 168 is the narrowest chamber. In fact, the chambers 152, 154, 156 and 158 can be configured to be successively narrower.

Each chamber can be fluidly coupled by passages through the base assembly 104 and housing 102 to an associated pressure source, such as a pump or pressure or vacuum line. One or more passages from the base assembly 104 can be linked to passages in the housing by flexible tubing that extends inside the loading chamber 108 or outside the carrier head. Thus, pressurization of each chamber, and the force applied by the associated segment of the main portion 142 of the flexible membrane 140 on the substrate, can be independently controlled. This permits different pressures to be applied to different radial regions of the substrate during polishing, thereby compensating for non-uniform polishing rates caused by other factors or for non-uniform thickness of the incoming substrate.

To vacuum chuck the substrate, one chamber, e.g., the outermost chamber 168, is pressurized to force the associated segment of the flexible membrane 140 against the substrate 10 to form a seal. Then one or more of the other chambers located radially inside the pressurized chamber, e.g., the fourth chamber 166 or the second chamber 162, are evacuated, causing the associated segments of the flexible membrane 140 to bow inwardly. The resulting low-pressure pocket between the flexible membrane 140 and the substrate 10 vacuum-chucks the substrate 10 to the carrier head 100, while the seal formed by pressurization of the outer chamber 168 prevents ambient air from entering the low-pressure pocket.

Since it is possible for the vacuum-chucking procedure to fail, it is desirable to determine whether the substrate is actually attached to the carrier head. To determine whether the substrate is attached to the flexible membrane, the fluid control line to one of the chambers, e.g., the third chamber 164, is closed so that the chamber is separated from the pressure or vacuum source. The pressure in the chamber is measured after the vacuum-chucking procedure by a pressure gauge connected to the fluid control line. If the substrate is present, it should be drawn upwardly when the chamber 162 is evacuated, thereby compressing the third chamber 164 and causing the pressure in the third chamber to rise. On the other hand, if the substrate is not present, the pressure in the third chamber 164 should remain relative stable (it may still increase, but not as much as if the substrate were present). A general purpose computer connected to the pressure gauge can be programmed to use the pressure measurements to determine whether the substrate is attached to the carrier head. The chambers that are not used for sealing, vacuum-chucking or pressure sensing can be vented to ambient pressure.

Figure 2:
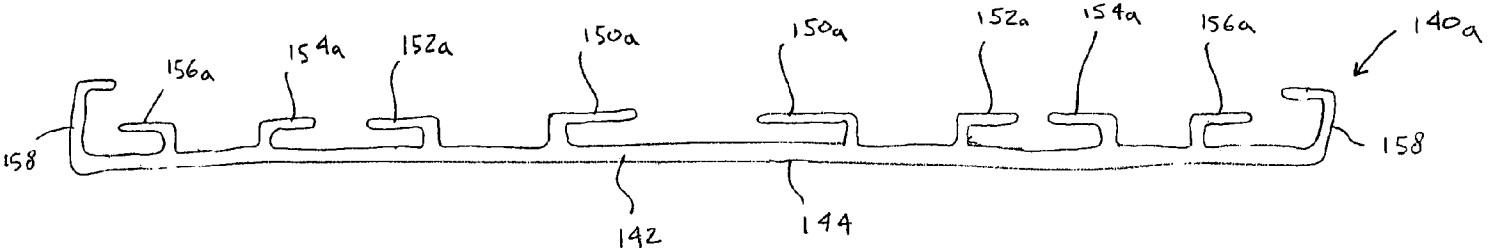
FIGS. 2 and 3 illustrate an implementation of a flexible membrane for the carrier head.
Figure 3:
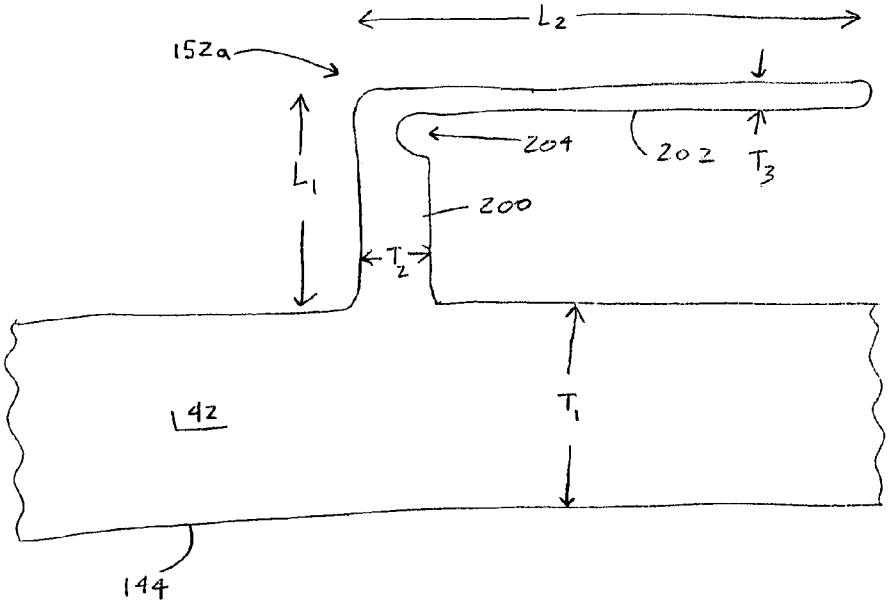

Referring to FIGS. 2 and 3, in one implementation, each of the annular flaps 150*a*, 152*a*, 154*a*, and 156*a*, except the outermost flap 158, of the flexible membrane 140*a* includes a vertically extending portion 200 and a horizontally extending portion 202 (only a single flap 150*b* is shown in FIG. 3). A notch 204 may be formed in the membrane at the intersection of the vertex between the vertically extending portion 200 and the horizontally extending portion 202. The main portion 142 has a thickness $T_1$, the vertically extending portion 200 has a thickness $T_2$ which is less than $T_1$, and the horizontally extending portion 202 has a thickness $T_3$ which is less than $T_2$. In particular, the thickness $T_2$ may be about ⅓ to ⅙ the thickness $T_1$, and the thickness $T_3$ may be about ½ to ¼ the thickness $T_2$. The vertically extending portion 200 may extend substantially vertically along a length $L_1$, whereas the horizontally extending portion 202 may extend substantially horizontally along a length $L_2$ which is greater than $L_1$. In particular, the length $L_2$ may be about 1.5 to 3 times the length $L_1$.

In operation, when one of the chambers is pressurized or evacuated, the horizontally extending portion 202 flex to permit the main portion 142 to move up and down. This reduces torsion or other transmission of loads to the main portion 142 of the flexible membrane through the flap that might result due to unequal pressure in adjacent chambers. Thus, unintended compressions in the main portion 142 at the junction of the flap to the main portion can be reduced. Consequently, the pressure distribution on the substrate at the region transitioning between two chambers of different pressure should be generally monotonic, thereby improving polishing uniformity.

Figure 4:
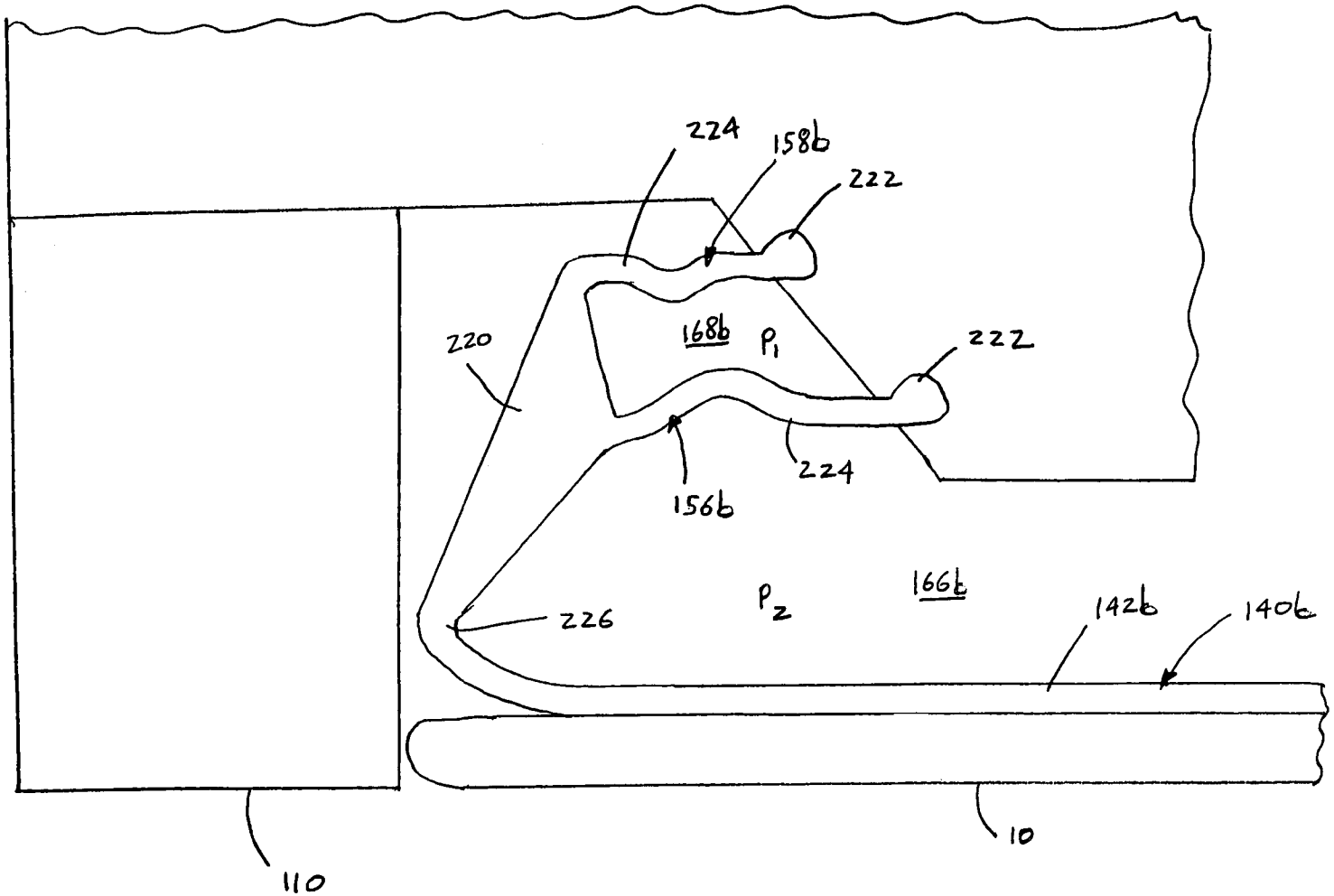
FIG. 4 illustrate an optional implementation for an edge portion of the flexible membrane.

Referring to FIG. 4, in another implementation, which can be combined with the other implementations, the flexible membrane 140*b* includes a main portion 142*b* and an outer portion 220 with a triangular cross-section connected to the outer edge of the main portion 142*b* . The three innermost annular flaps are connected to the main portion 142*b* of the flexible membrane 140*b* but the two outermost annular flaps 156*b* and 158*b* are connected to the two vertices of the triangular outer portion 220. The innermost flaps include both the horizontal portion and the vertical portion, whereas in the two outermost annular flaps 156*b* and 158*b* , the horizontal portion 224 connects directly to the triangular outer portion 220.

The two outer chambers 166*b* and 168*b* , can be used to control the pressure distribution on the outer perimeter of the substrate. If the pressure $P_1$ in the outermost chamber 168*b* is greater than the pressure $P_2$ in the second chamber 166*b* , the outer portion 220 of the flexible membrane 140*b* is driven downwardly, causing the lower vertex 226 of the outer portion 220 to apply a load to the outer edge of the substrate. On the other hand, if the pressure $P_1$ in the outermost chamber 168*b* is less than the pressure $p_2$ in the second chamber 166*b* (as shown in FIG. 4), the outer portion 220 pivots so that the lower vertex 226 is drawn upwardly. This causes the outer edge of the main portion 142*b* to be drawn upwardly and away from the perimeter portion of the substrate, thereby reducing or eliminating the pressure applied on this perimeter portion. By varying the relative pressures in the chambers 166*b* and 168*b*, the radial width of the section of the membrane pulled away from the substrate can also be varied. Thus, both the outer diameter of the contact area between the membrane and the substrate, and the pressure applied in that contact area, can be controlled in this implementation of the carder head.

The configurations of the various elements in the carrier head, such as the relative sizes and spacings the retaining ring, the base assembly, or the flaps in the flexible membrane are illustrative and not limiting. The carrier head could be constructed without a loading chamber, and the base assembly and housing can be a single structure or assembly. Notches can be formed in other locations on the membrane, the different flaps may have different numbers of notches, some or all of the flaps may be formed without notches, and there can be one or more notches on the outermost flap. The flaps could be secured to the base in other clamping configurations, mechanisms other than clamps, such as adhesives could be used to secure the flexible membrane, and some of the flaps could be secure to different portions of the carrier head than the base.

The present invention has been described in terms of a number of embodiments. The invention, however, is not limited to the embodiments depicted and described. Rather, the scope of the invention is defined by the appended claims.

The invention claimed is:

1. A carrier head for positioning a substrate on a polishing surface, comprising:

a housing connectable to a drive shaft to rotate therewith;

a lower assembly having a substrate mounting surface; and a gimbal mechanism that connects the housing to the lower assembly to permit the lower assembly to pivot with respect to the housing about an axis substantially parallel to the polishing surface, the gimbal mechanism including a shaft having an upper end slidably disposed in a vertical passage in the housing, and a lower member that connects a lower end of the shaft to the lower assembly, wherein the lower member bends to permit the lower assembly to pivot with respect to the housing, the shaft and the lower member being a unitary body.

2. The carrier head of claim 1 wherein the lower member comprises an annular ring with an inner circumferential portion joined to the shaft and an outer circumferential portion connected to the lower assembly.

3. The carrier head of claim 1 wherein the lower member is bendable vertically but is rigid radially.

4. The carrier head of claim 1, wherein the lower assembly includes a flexible membrane having the mounting surface for the substrate.

5. The carrier head of claim 4, wherein the flexible membrane extends beneath the lower member to define a boundary of a pressurizable chamber.

6. The carrier head of claim 1, wherein the lower assembly includes a rigid annular body joined to the lower member.

7. The carrier head of claim 6, wherein a retaining ring is secured to an outer lower surface of the rigid annular body.

8. The carrier head of claim 6, wherein the flexible membrane is secured to the rigid annular body.

9. The carrier head of claim 8, wherein the flexible membrane includes a plurality of flaps, and the lower assembly includes at least one clamp ring securing the plurality of flaps to the rigid annular body.

10. The carrier head of claim 1, wherein the lower assembly includes a retaining ring.

11. The carrier head of claim 1, further comprising a loading mechanism connecting the housing to the lower assembly to apply a downward pressure to the lower assembly.

12. The carrier head of claim 11, wherein the loading mechanism includes a flexure sealing a volume between the lower assembly and the housing to form a pressurizable chamber.

* * * * *